US005931407A

United States Patent [19]

Uwagaki et al.

[11] Patent Number: 5,931,407

[45] Date of Patent: Aug. 3, 1999

[54] PAPER FEEDING MECHANISM FOR ROLLED PAPER

[75] Inventors: Hideo Uwagaki, Kyoto; Hironori Tanaka, Yamatokoriyama; Shogo Kimura, Nara, all of Japan

[73] Assignee: Sharp Kabushiki Kaisha, Osaka, Japan

[21] Appl. No.: 09/072,746

[22] Filed: May 6, 1998

[51] Int. Cl.[6] ..... B65H 16/02; B65H 20/02

[52] U.S. Cl. ..... 242/564.4; 242/566; 242/595; 400/613

[58] Field of Search ..... 242/564.3, 564.4, 242/566, 595.1, 538.3; 400/613; 101/228, 232

[56] References Cited

U.S. PATENT DOCUMENTS

| | | | |
|---|---|---|---|
| 3,861,610 | 1/1975 | Landis et al. | 242/564.4 |
| 5,060,076 | 10/1991 | Curley | 400/613 |
| 5,060,877 | 10/1991 | Bullivant | 242/566 |
| 5,820,068 | 10/1998 | Hosomi et al. | 242/595 |

FOREIGN PATENT DOCUMENTS

| | | |
|---|---|---|
| 6-71971 | 3/1994 | Japan . |
| 8-169144 | 7/1996 | Japan . |

*Primary Examiner*—John M. Jillions

[57] ABSTRACT

It is an object of the present invention to provide a paper feeding mechanism for rolled paper which is easily set and has excellent carriageablity. When rolled paper is set, one guide member is pressed downward by an opened cover so that it comes closer to a body. At this time, a protruding member provided on the one guide member abuts against the other guide member. When the paper feeding mechanism operates, the cover is closed so that the one guide member separates from the body and urged toward the other guide member by an urging member, whereby the protruding member abuts against the other guide member. Therefore, since a width of a carrying path is held by a height of the protruding member between the one and other guide members, insertion of a rolled paper end is facilitated, and thus the paper can be smoothly carried with the aid of the tension of the paper.

3 Claims, 4 Drawing Sheets

PAPER FEEDING MECHANISM FOR ROLLED PAPER

BACKGROUND OF THE INVENTION

1. Field of the Invention

The present invention relates to a paper feeding mechanism for rolled paper which is preferably used in a printing apparatus for recording image information from a personal computer, a facsimile apparatus or the like, for example.

2. Description of the Related Art

FIGS. 3A and 3B are side views of a printing apparatus 31 comprising a prior-art paper feeding mechanism for rolled paper. The printing apparatus 31 includes a body 32 and a cover 33. The cover 33 is placed on the top of the body. The cover 33 is angularly displaced about a pin 34 disposed on the body 32, whereby the cover 33 is opened/closed with respect to the body 32. The pin 34 is provided on an upper portion near one side surface 35 of the body 32 along this side surface. The body 32 comprises a rolled paper storage portion 36, a platen roller 37 and one guide member 38. The cover 33 comprises a printing head 39 and another guide member 40. Paper is carried between the body 32 and the cover 33 from another side surface opposite to the one side surface 35 of the body 32 toward the one side surface 35 near which the pin 34 is dispoed. Therefore, in the body 32, from upstream toward downstream in a paper carrying direction 41, the rolled paper storage portion 36, the platen roller 37 and the one guide member 38 are arranged in this order. In the cover 33, in the same direction, the printing head 39 and the other guide member 40 are arranged in this order.

The rolled paper storage portion 36 is disposed on a lower portion near the other side surface of the body so that rolled paper 42 may be covered with the side surface of the body 32. The printing head 39 and the platen roller 37 are located so that they may be opposite to each other when the cover 33 is closed. The platen roller 37 is used for carrying the paper by its rotation using a friction generated between the platen roller 37 and the paper. The one guide member 38 and the other guide member 40 are located so that they may be opposite to each other when the cover 33 is closed. A carrying path 43 of a relatively narrow space is formed by the one and other guide members 38, 40. The printing apparatus 31 has a structure in which the paper carrying path is provided between the body 32 and the cover 33.

Referring to a side view of the printing apparatus 31 with the cover 33 opened as shown in FIG. 3B, an operation of setting the rolled paper 42 will be described. In the first place, the cover 33 is opened and the rolled paper 42 is placed in the rolled paper storage portion 36 so that it may be pulled out from an upper side along the direction of pulling out the paper. A rolled paper end 44 pulled out for setting is sequentially passed between the platen roller 37 and the printing head 39 and between the one guide member 38 and the other guide member 40, in between the body 32 and the cover 33. Then the cover 33 is closed and the operation of setting the rolled paper 42 is completed.

Referring to a side view of the printing apparatus 31 with the cover 33 closed as shown in FIG. 3A, a printing operation will be described below. Image data and control data such as printing speed are sent to the printing head 39 from an information processing apparatus (not shown) connected to the apparatus. The control data such as rotational speed is sent to the platen roller 37. The printing speed of the printing head 39 and paper carrying speed by the rotation of the platen roller 37 are controlled so that they may be in a mutually optimum condition, whereby a printing is performed. The paper pulled out by the rotation of the platen roller 37 is first printed by the printing head 39, and the paper passes between the printing head 39 and the platen roller 37. Then, a carrying force of the platen roller 37 is applied to the paper and the paper passes through the carrying path 43, so that the paper is discharged from the printing apparatus 31.

In the paper feeding mechanism included in this printing apparatus 31, the one and other guide members 38, 40 are fixed on the body 32 and the cover 33, respectively, and a shape of the paper carrying path 43 is changed by opening/closing the cover 33.

FIGS. 4A and 4B are side views of a printing apparatus 51 comprising another prior-art paper feeding mechanism for rolled paper. The printing apparatus 51 comprises a body 52 and a cover 53. The cover 53 is disposed on the top of the body. The cover 53 is angularly displaced about a pin 54 provided on the body 52, whereby the cover 53 is opened/closed with respect to the body 52. The body 52 comprises a rolled paper storage portion 55 and a printing head 56. The cover 53 comprises a platen roller 57 and a guide path 58. The rolled paper storage portion 55 partially protrudes from one side surface 59 of the body. This protruding portion 60 is used for disposing the pin 54. Specifically, in a portion in which the protruding portion 60 of a housing of the body 52 and a housing of the cover 53 overlap each other the two pins 54 are arranged so that only the housings may be connected. Therefore, this has no influence on the accommodation or operation of rolled paper 61. The printing head 56 is disposed near another side surface opposite to the one side surface 59 near which the rolled paper storage portion 55 is mounted. The printing head 56 and the platen roller 57 are located so that they may be opposite to each other when the cover 53 is closed. A relatively narrow guide path 58 of constant width is provided from the platen roller 57 toward a cover upper surface 62 so that it may be inclined toward a position in which the rolled paper is set.

Referring to a side view of the printing apparatus 51 with the cover 53 opened as shown in FIG. 4B, an operation of setting the rolled paper 61 will be described below. In the first place, the cover 53 is opened and the rolled paper 61 is placed in the rolled paper storage portion 55 so that it may be pulled out from a lower side along the direction of pulling out the paper. In order that the paper is passed between the printing head 56 and the platen roller 57, a pulled-out rolled paper end 63 passes along a side surface 64 opposite to the pin 54 of the platen roller 57, and the rolled paper end 63 is inserted into the guide path 58. Then, the cover 53 is closed and the operation of setting the rolled paper 61 is completed.

Referring to a side view of the printing apparatus 51 with the cover 53 closed as shown in FIG. 4A, a printing operation will be described below. In the same manner as the prior art shown in FIGS. 3A and 3B, image data and control data such as printing speed from an information processing apparatus (not shown) are sent to the printing head 56. The control data such as rotational speed is sent to the platen roller 57. The printing speed of the printing head 56 and the rolled paper carrying speed of the platen roller 57 are controlled so that they may be in a mutual optimum condition, whereby the printing is performed. After leaving a printing section, the rolled paper 61 passes through the narrow guide path 58 disposed in the cover 53, and is discharged from the printing apparatus 51.

In the paper feeding mechanism provided in this printing apparatus 51, since the guide path 58 is provided in the cover 53, a shape of the guide path 58 is not changed even during the printing operation and the operation of setting the paper.

In the paper feeding mechanism for rolled paper, when the guide members of the carrying path are separately arranged in the body and the cover, the shape of the carrying path is changed by opening the cover to set the paper. For example, In the case where a relatively acute-angled portion is formed, the rolled paper end is caught on the side surface of the carrying path, and thus smooth insertion of the paper is difficult. More specifically, since the rolled paper is curled when it is pulled out, the paper is considerably caught depending on relationship between the orientation of the angled portion and the orientation of curl of the rolled paper to be carried, and thus the smooth insertion of the paper is extremely difficult. Also, in the case where the carrying path is too wide, the paper is bent due to reduced paper tension, and thus the paper is prone to be caught and jammed in the carrying path.

SUMMARY OF THE INVENTION

It is therefore an object of the present invention to provide a paper feeding mechanism for rolled paper which is easily attached and has excellent carriageablity.

In one aspect of the present invention, there is provided a paper feeding mechanism for rolled paper comprising a body in which the rolled paper is set; and a cover which is opened/closed with respect to the body by angular displacement about a pin provided in the body, a path for carrying the rolled paper, being formed between the body and the cover on the pin side, the mechanism further comprising:

one guide member having:

a fixed end which is located upstream in a carrying direction and fixed on the body, and a free end which is located downstream in the carrying direction and rotatable in the carrying path about the fixed end so as to come closer to/separate from the body;

another guide member provided on the carrying path side of the cover so as to be opposite to the one guide member;

a protruding member provided on at least one end of the one guide member in a direction orthogonal to the rolled paper carrying direction so as to be oriented toward the other guide member; and an urging member for urging the one guide member toward the other guide member, wherein, when the cover is opened the one guide member is pressed downward by the cover, whereby the one guide member comes closer to the body and the protruding member disposed on the one guide member and the other guide member abut against each other, and when the cover is closed, the one guide member is urged toward the other guide member by the urging member, whereby the one guide member separates from the body and the protruding member disposed on the one guide member and the other guide member abut against each other.

According to the present invention, when the cover is opened and closed, the rolled paper carrying path, which is formed between the one and other guide members, is held to have a relatively narrow same width by the rotatable one guide member, the urging member and the protruding member. Thereby, in setting the rolled paper insertion of the rolled paper end is facilitated and thus the rolled paper is easily placed. Also, when the paper feeding mechanism is used, since the rolled paper is tensed, smooth carriage can be accomplished.

In another aspect of the present invention, the one and other guide members have their engagement portion in which they are engaged with each other when the cover is closed.

According to the present invention, when the cover is closed, the one and other guide members are engaged with each other in their engagement portion. Thus, the free end of the rotatable one guide member is lowered by a weight of the discharged rolled paper so that the one guide member is fixedly positioned, whereby it is possible to prevent the carrying path from widening. The smooth carriage can be therefore continued with the aid of the tension of the rolled paper.

In a still another aspect of the present invention, the one and other guide members have respectively smoothly-curved surfaces which form the carrying path.

According to the present invention, when the cover is opened and closed, the smoothly-shaped carrying path is formed with the smoothly-curved surfaces of the one and other guide members. Thus, the rolled paper can be set without catching its end, and the smooth carriage can be also accomplished.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
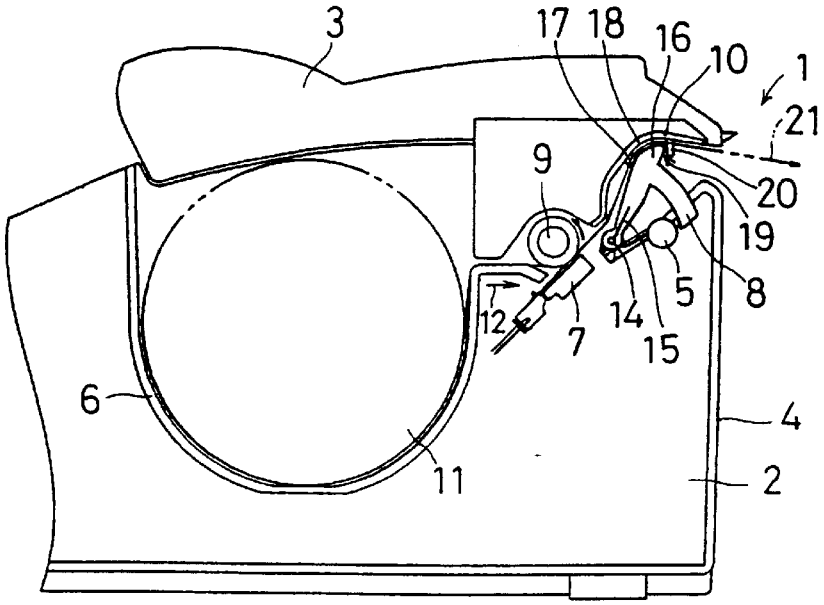
FIG. 1A is a side view of a printing apparatus 1 having a paper feeding mechanism according to an embodiment of the present invention with a cover 3 closed.

Now referring to the drawings, preferred embodiments of the invention are described below.

Figure 1B:
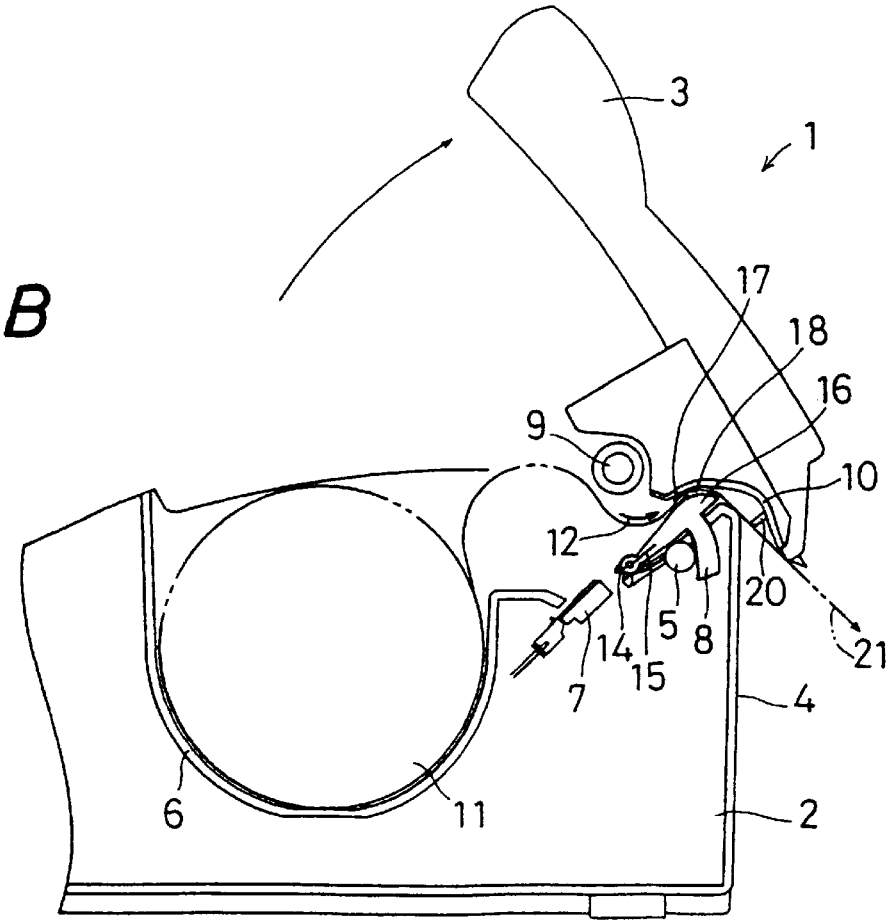
FIG. 1B is a side view of the printing apparatus 1 with the cover 3 opened.

FIGS. 1A and 1B are side views of a printing apparatus 1 having a paper feeding mechanism for rolled paper according to an embodiment of the present invention. A cover 3 is closed in FIG. 1A, while the cover 3 is opened in FIG. 1B. The printing apparatus 1 comprises a body 2 and a cover 3. The cover 3 is placed on the top of the body 2. The cover 3 is angularly displaced about a pin 5 provided on an upper portion near one side surface 4 of the body 2. The pin 5 is disposed along the one side surface 4 of the body 2, whereby the cover 3 is opened/closed with respect to the body 2.

The body 2 comprises a rolled paper storage portion 6, a printing head 7 and one guide member 8. The cover 3 comprises a platen roller 9 and another guide member 10. A path for carrying rolled paper 11 is formed between the body 2 and the cover 3 so that it may be directed from another side surface opposite to the one side surface 4, near which the pin 5 is provided, toward the one side surface 4. Therefore, in the body, from upstream toward downstream in a paper carrying direction 12, the rolled paper storage portion 6, the printing head 7 and the one guide member 8 are arranged in this order. In the cover, in the same directions, the platen roller 9 and the other guide member 10 are arranged in this order.

The rolled paper storage portion 6 is disposed on a lower portion near the other side surface of the body 2. Accordingly, the rolled paper 11 is located so that it may be covered with a body housing. The printing head 7 is used for printing onto the rolled paper 11. The platen roller 9 rotates along the paper carrying direction 12 so as to carry the paper. The printing head 7 and the platen roller 9 are located so that they may be opposite to each other when the cover 3 is closed.

Figure 2A:
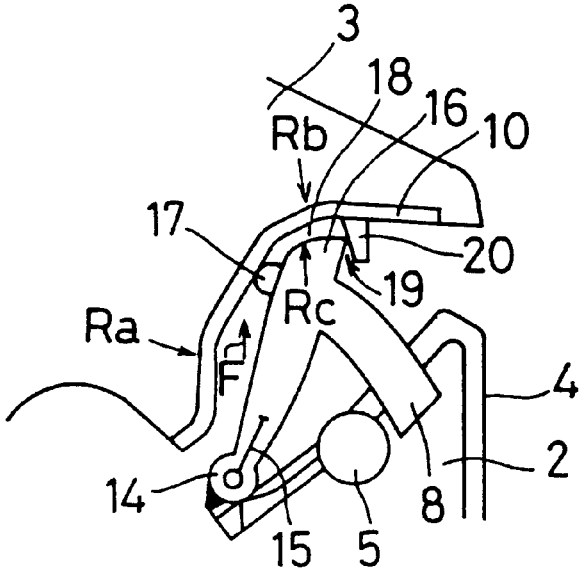
FIG. 2A is an enlarged side view of one and other guide members 8, 10 and their vicinities of the printing apparatus 1 with the cover 3 closed.
Figure 2B:
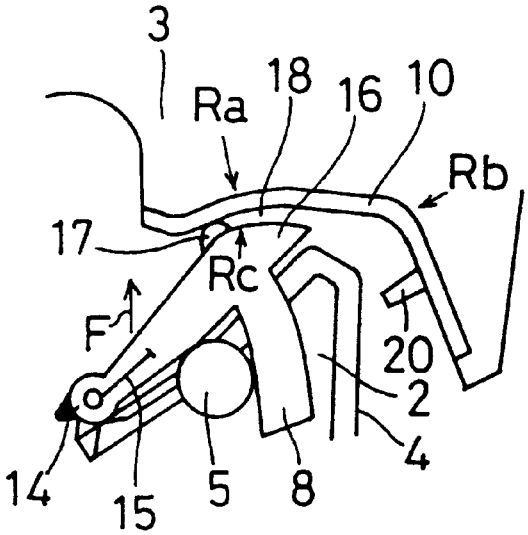
FIG. 2B is an enlarged side view of the one and other guide members 8, 10 and their vicinities of the printing apparatus 1 with the cover 3 opened.
Figure 3A:
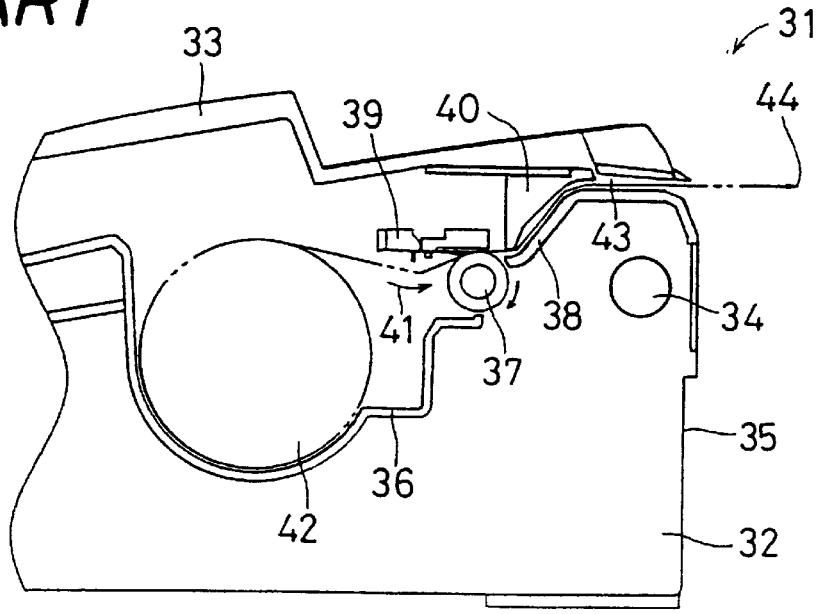
FIG. 3A PRIOR ART
FIG. 3A is a side view of a printing apparatus 31 comprising a prior-art paper feeding mechanism for rolled paper with a cover 33 closed.
Figure 3B:
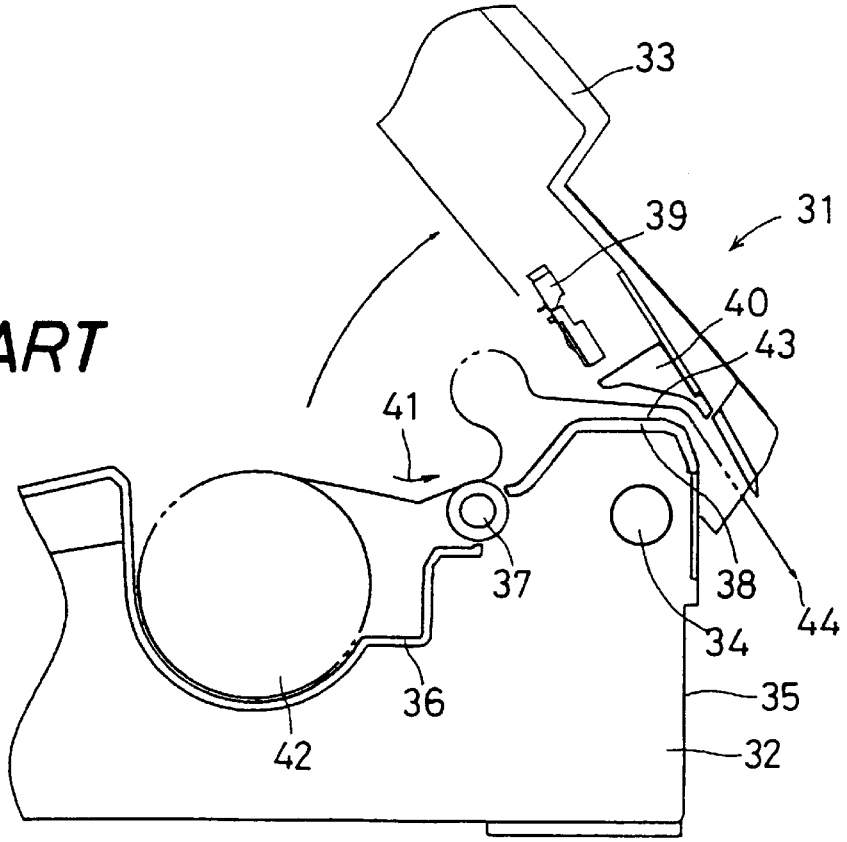
FIG. 3B PRIOR ART
FIG. 3B is a side view of the printing apparatus 31 with the cover 33 opened.
Figure 4A:
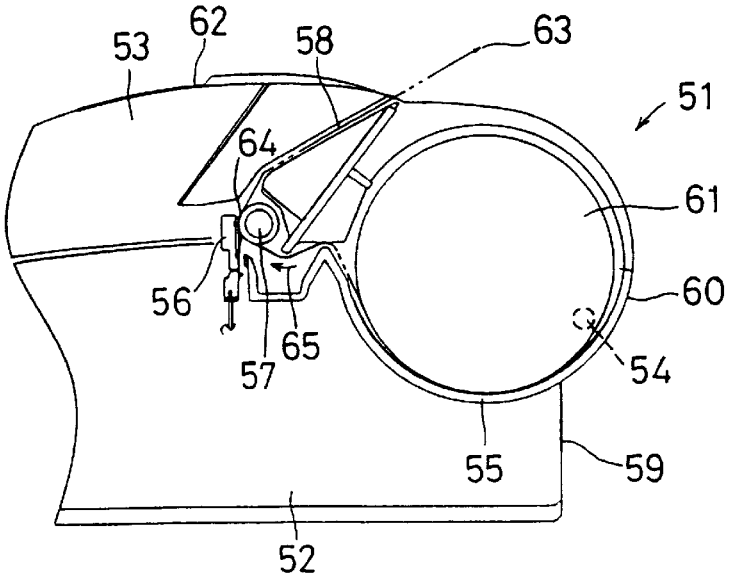
FIG. 4A PRIOR ART
FIG. 4A is a side view of a printing apparatus 51 comprising another prior-art paper feeding mechanism for rolled paper with a cover 53 closed.
Figure 4B:
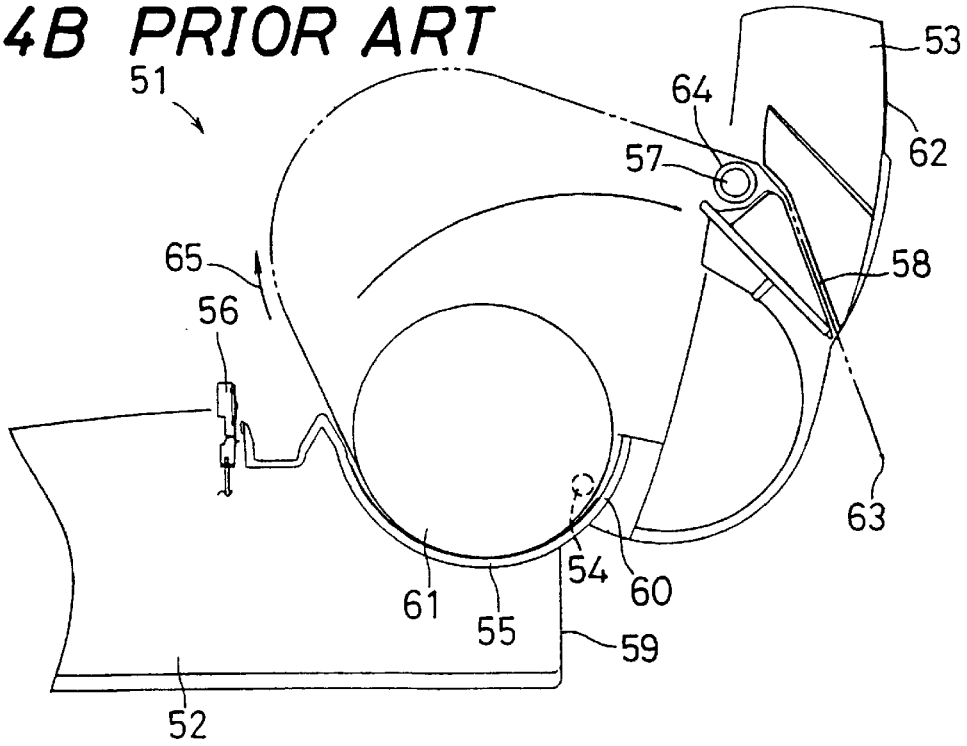
FIG. 4B PRIOR ART
FIG. 4B is a side view of the printing apparatus 51 with the cover 53 opened.

FIGS. 2A and 2B are enlarged side views of the one and other guide members 8, 10 and their vicinities included in the printing apparatus 1 of FIGS. 1A and 1B. The cover 3 is closed in FIG. 2A, while the cover 3 is opened in FIG. 2B. The one guide member 8 provided in the body is positioned above the pin 5. The one guide member 8 has a fixed end 14 on the printing head 7 side, located upstream in the paper carrying direction 12 and, a free end 16 on the opposite side, so that the one guide member 8 is rotatable. As an urging member for urging a force F directing upward at all times, a spring 15 is provided on the fixed end 14. The free end 16 of the one guide member 8 has a smoothly-convex curved surface Rc near the other guide member 10. The other guide member 10 is disposed opposite to the one guide member 8. In order to form a paper carrying path 18 of constant width between the one guide member 8 and the other guide member 10, a protruding member 17 is provided on the curved surface Rc of the one guide member 8. On the other hand, the other guide member 10 disposed in the cover 3 has two smoothly-concave curved surfaces Ra, Rb along the curved surface Rc of the one guide member 8 when the cover 3 is opened and closed. By these curved surfaces Ra, Rb and the curved surface Rc of the one guide member 8, the smooth carrying path 18 is formed.

On the other guide member 10, provided is a stopper 20 which forms an engagement portion 19 by engaging with an endmost of the free end 16 of the one guide member 8 when the cover 3 is closed. The protruding member 17 and the stopper 20 are located on the one guide member 8 and the other guide member 10, respectively, outside a range in which the paper is carried in the direction of the pin, and they do not interfere with the carriage of the paper. For example, they are arranged in two places each on both ends outside the range in which the paper is carried, so that the width of the carrying path 18 is held constant. The paper feeding mechanism for rolled paper comprises the body 2, the cover 3, the one and other guide members 8, 10, the urging member 15, the protruding member 17 and the stopper 20.

Referring to side views of the printing apparatus 1 with the cover 3 opened as shown in FIGS. 1B and 2B, an operation of setting the rolled paper 11 will be described below. In the first place, the cover 3 of the printing apparatus 1 is opened, and the rolled paper 11 is then placed in the rolled paper storage portion 6 so that it may be pulled out from the lower side in the direction of pulling out the paper. At this time, a cover end above the one side surface 4 of the body 2 is lowered, so that the one guide member 8 rotates in the direction in which it is pressed downward by the cover end. Then, the protruding member 17 disposed on the one guide member 8 abuts against the other guide member 10, whereby the width of the paper carrying path 18 is held by a height of the protruding member 17. The height of the protruding member 17 is selected, whereby the width of the carrying path 18 can be relatively narrowed. At this time, the convex curved surface Rc of the one guide member 8 corresponds to the concave curved surface Ra of the other guide member 10, so that the smooth carrying path 18 is obtained. This allows a rolled paper end 21 to be smoothly inserted into the carrying path 18 formed between the one and other guide members 8 and 10. Then, the cover 3 is closed, whereby the operation of setting the rolled paper 11 is completed. At this time, the convex curved surface Rc of the one guide member 8 corresponds to the concave curved surface Rb of the other guide member 10.

Referring to side views of the printing apparatus 1 with the cover 3 closed as shown in FIGS. 1A and 2A, a printing operation will be described below. Image data and control data such as printing speed are sent to the printing head 7 from an information processing apparatus (not shown) connected to the printing apparatus 1. The control data such as rotational speed is sent to the platen roller 9. In the printing apparatus 1, the printing speed of the printing head 7 and the rotational speed of the platen roller 9 are controlled, and the information is printed on the rolled paper 11. Therefore, after the information is printed on the rolled paper 11 by the printing head 7, the rolled paper 11 is sent to the carrying path 18 by the platen roller 9. In the carrying path 18, by an action of the spring 15 disposed on the one guide member 8, the one guide member 8 is separated from the body 2 and urged toward the other guide member 10. At this time, the protruding member 17 disposed on the one guide member 8 abuts against the other guide member 10, so that the relatively narrow width of the carrying path 18 is held between the one and other guide members 8 and 10. The curved surfaces Rc and Rb of the one and other guide members 8 and 10 also correspond to each other, so that the smooth carrying path 18 is obtained. Thus, since the paper is tensed, the paper is smoothly carried without a jam in the carrying path 18 due to its bending, and the rolled paper 11 is then discharged from the printing apparatus 1.

When the information is printed on the rolled paper 11 and the rolled paper 11 is discharged from the printing apparatus 1, a downward force enlarging the width of the carrying path 18 is applied to the free end 16 of the one guide member 8 by a weight of the discharged paper. However, the stopper 20 disposed on the other guide member 10 is engaged with the endmost of the free end 16 of the one guide member 8 so as to form the engagement portion 19, whereby the relatively narrow carrying path 18 is held. Thereby, the rolled paper 11 is continuously smoothly carried without being caught and jammed.

When the rolled paper 11 is set in the same manner as this embodiment, the end 21 of the rolled paper 11 is directed toward the upper side of the carrying path due to a curl of the rolled paper 11. Thus, the rolled paper 11 is placed so that the end 21 of the rolled paper 11 may be located along the upper side of the carrying path, and this is more specifically prone to cause the paper to be caught. However, since the carrying path 18 is smoothly shaped in the paper feeding mechanism of this embodiment, the end 21 of the rolled paper 11 is little caught. Moreover, since this mechanism has a structure in which the width of the carrying path 18 can be held relatively narrow, the paper can be carried with the aid of the tension of the paper without being caught.

The present invention includes an application of the paper feeding mechanism of this embodiment not only when the rolled paper 11 is set so that the end 21 of the rolled paper 11 may be directed toward the upper side of the carrying path but also when the rolled paper 11 is conversely set so that the end 21 of the rolled paper 11 may be directed toward the lower side of the carrying path.

The present invention also includes the application of the paper feeding mechanism for rolled paper of this embodiment to not only the printing apparatus 1 but also the apparatus for carrying the rolled paper 11.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A paper feeding mechanism for rolled paper, comprising, a body in which the rolled paper is set; and a cover which is opened/closed with respect to the body by angular displacement about a pin provided in the body, wherein a carrying path for carrying the rolled paper is formed between the body and the cover on the pin side, the mechanism further comprising:

one guide member having:

a fixed end which is located upstream in a carrying direction and fixed on the body, and a free end which is located downstream in the carrying direction and rotatable in the carrying path about the fixed end so as to come closer to/separate from the body;

another guide member provided on the carrying path side of the cover so as to be opposite to the one guide member;

a protruding member provided on at least one end of the one guide member in a direction orthogonal to the rolled paper carrying direction so as to be oriented toward the other guide member; and an urging member for urging the one guide member toward the other guide member;

wherein, when the cover is opened, the one guide member is pressed downward by the cover, whereby the one guide member comes closer to the body and the protruding member disposed on the one guide member and the other guide member abut against each other; and when the cover is closed, the one guide member is urged toward the other guide member by the urging member, whereby the one guide member separates from the body and the protruding member disposed on the one guide member and the other guide member abut against each other.

2. The paper feeding mechanism for feeding rolled paper of claim 1, wherein the one and other guide members have engagement portions by which they are engaged with each other when the cover is closed.

3. The paper feeding mechanism for feeding rolled paper of claim 1, wherein the one and other guide members have respectively smoothly-curved surfaces which form the carrying path.

* * * * *

UNITED STATES PATENT AND TRADEMARK OFFICE

CERTIFICATE OF CORRECTION

PATENT NO. : 5,931,407

DATED : Aug. 3, 1999

INVENTOR(S) : Uwagaki et al.

It is certified that error appears in the above-identified patent and that said Letters Patent is hereby corrected as shown below:

On the title page:

Please insert category "[30] Foreign Application Priority Data" as follows:

-- [30] Foreign Application Priority Data

May 15, 1997 [JP] Japan ..... 9-126111 --

Signed and Sealed this

Fourteenth Day of March, 2000

*Attest:*

Q. TODD DICKINSON

*Attesting Officer*

*Commissioner of Patents and Trademarks*